US006008478A

United States Patent [19]

Crone et al.

[11] Patent Number: 6,008,478

[45] Date of Patent: Dec. 28, 1999

[54] HEATING ELEMENT SUPPORT SYSTEM FOR OVEN

[75] Inventors: Connie Rae Crone, Mason; Gregory J. Paul, Greenville; George A. Mikalauskas, Pleasant Hill, all of Ohio; Corinne M. Troiano, Broken Arrow, Okla.; Kevin Cheesebrough, Dayton, Ohio

[73] Assignee: Whirlpool Corporation, Benton Harbor, Mich.

[21] Appl. No.: 08/969,801

[22] Filed: Nov. 13, 1997

Related U.S. Application Data

[60] Provisional application No. 60/027,430, Dec. 5, 1996.

[51] Int. Cl.[6] ..... A21B 1/00

[52] U.S. Cl. ..... 219/402; 219/403; 219/404

[58] Field of Search ..... 219/407, 406, 219/391, 403, 402, 404, 405

[56] References Cited

U.S. PATENT DOCUMENTS

| | | | |
|---|---|---|---|
| 1,225,827 | 5/1917 | Kuhn et al. . | |
| 1,282,195 | 10/1918 | Crary . | |
| 1,676,876 | 7/1928 | Stannard . | |
| 2,498,583 | 2/1950 | Schulze | 219/35 |
| 2,658,986 | 11/1953 | Gronlund | 219/35 |
| 3,154,669 | 10/1964 | Binder | 219/404 |
| 3,161,755 | 12/1964 | Tilus | 219/403 |
| 3,162,754 | 12/1964 | Jasionowski | 219/403 |
| 3,171,946 | 3/1965 | Ammerman | 219/404 |
| 3,334,215 | 8/1967 | Allen, Jr. | 219/404 |
| 4,049,948 | 9/1977 | Gilreath | 219/404 |
| 4,358,669 | 11/1982 | Bryson, Jr. | 219/542 |
| 4,558,208 | 12/1985 | Sturdevant et al. | 219/399 |
| 4,590,360 | 5/1986 | Maitenaz et al. | 219/390 |
| 4,780,597 | 10/1988 | Linhart et al. | 219/404 |

FOREIGN PATENT DOCUMENTS

| | | | |
|---|---|---|---|
| 2653209 | 4/1991 | France | 219/407 |
| 353909 | 7/1931 | United Kingdom | 219/407 |

*Primary Examiner*—Philip H. Leung
*Assistant Examiner*—Shawntina Fuqua
*Attorney, Agent, or Firm*—Joel M. Van Winkle; Andrea Powers Denklau; Robert O. Rice

[57] ABSTRACT

An oven having a tray forming a heating element enclosure beneath an oven liner. The heating element compartment has a rear access opening. A heating element is removably supported by the tray beneath a bottom wall of the oven liner. An access panel is provided for closing the rear access opening of the heating element enclosure. The access panel is secured to the oven liner and the rear edge of the tray is fastened to the access panel. An inner chassis is disposed about the oven liner. The inner chassis includes a rear chassis panel and a chassis bottom panel having a rear edge removably attached to the rear chassis panel. A cabinet enclosure surrounds the inner chassis and includes a removable back wall. Access to the access panel is accomplished by removing the back wall and disconnecting the chassis bottom panel from the rear chassis panel such that the chassis bottom panel may be flexed to expose the access panel. Removal of the access panel provides access to the heating element such that it may be serviced.

6 Claims, 4 Drawing Sheets

HEATING ELEMENT SUPPORT SYSTEM FOR OVEN

This application claims benefit of Provisional Application No. 60/027,430, filed Dec. 5, 1996.

BACKGROUND OF THE INVENTION

The present invention relates to an oven, and more particularly to a system for supporting a heating element in an oven.

Conventional ovens employ electric resistance heaters or heating elements in an oven compartment for the baking and cooking foods. Typically, a heating element is disposed within the bottom of an oven cavity. It is the general practice to utilize heating elements which can be removed from the oven to facilitate cleaning and replacement if the element fails. Generally, these heating elements are supported along the bottom of the oven cavity and are plugged into a terminal connection in the rear of the oven, permitting removal of the element by breaking the electrical connection.

A common problem in using an oven is maintaining a clean interior oven cavity. In the conventional type oven described above, the removal and reinstallation of the heater element while cleaning the oven cavity has several disadvantages. The manipulation of the heating element is generally an awkward and tiresome activity. Moreover, the removal and reinstallation of the heater element may lead to a misinstallation or cause damage to the heating element.

Accordingly, some oven designs utilize an oven configuration wherein the heating element is disposed in a separate compartment provided below the oven cavity. These types of oven configurations may be referred to as hidden element ovens. In these types of configurations, cleaning is accomplished relatively easily because there is no visible heating element along the bottom of the oven cavity. The bottom wall of the oven cavity can be simply cleaned without the difficulties and complications associated with removing a heating element.

Hidden element ovens further provide the advantage of uniform heating of the oven cavity which can enhance the cooking performance of the oven. Heat from the hidden heating element is transferred to the underside of the bottom wall of the oven cavity and is conducted throughout the entire oven cavity body and is radiated into the cavity from all of the interior oven cavity surfaces in a relatively even manner.

While hidden element ovens offer the above described advantages over conventional ovens, there are some disadvantages which have prevented their wide spread use. One significant disadvantage is the relative difficulty in replacing the heating element if it should fail. In a conventional oven, since the heating element is supported along the bottom of the oven cavity and is plugged into a terminal connection in the rear of the oven—the heating elements can be easily removed. In a hidden element oven, since the heating element is in a compartment below the oven cavity, the heating element can not be readily accessed for service. The prior art has, heretofore, provided few solutions to this problem.

SUMMARY OF THE INVENTION

It would be an improvement in the art, therefore, to provide a relatively simple and cost effective hidden element oven design.

Moreover, it would be a substantial improvement to provide a hidden element oven design which allowed for relatively easy access and replacement of the heating element.

Accordingly, the present invention is directed to an oven having a tray forming a heating element compartment disposed beneath an oven liner which defines an oven cavity. The heating element compartment has a rear access opening. A heating element is removably supported by the tray beneath a bottom wall of the oven liner and may be inserted into the heating element compartment through the rear access opening. An access panel is provided for closing the rear access opening of the heating element enclosure. The access panel is secured to the oven liner and the rear edge of the tray is fastened to the access panel.

An inner chassis is disposed about the oven liner forming an insulation cavity in the space between the inner chassis and the oven liner. The inner chassis includes a rear chassis panel and a chassis bottom panel having a rear edge removably attached to the rear chassis panel. A cabinet enclosure surrounds the inner chassis forming an open air space in the space between the inner chassis and the cabinet enclosure. The cabinet has a removable back wall wherein access to the access panel is accomplished by removing the back wall and disconnecting the chassis bottom panel from the rear chassis panel such that the chassis bottom panel may be flexed to expose the access panel. Removal of the access panel provides access to the heating element such that it may be serviced.

BRIEF DESCRIPTION OF THE PREFERRED EMBODIMENTS

The present invention is shown embodied in a built-in oven designed for insertion into a wall opening. While the present invention is shown embodied in a built-in oven, the present invention is not limited to built-in oven configurations and could be beneficially employed in other oven configurations such as a stand alone range configuration having a stove top and oven.

Figure 1:
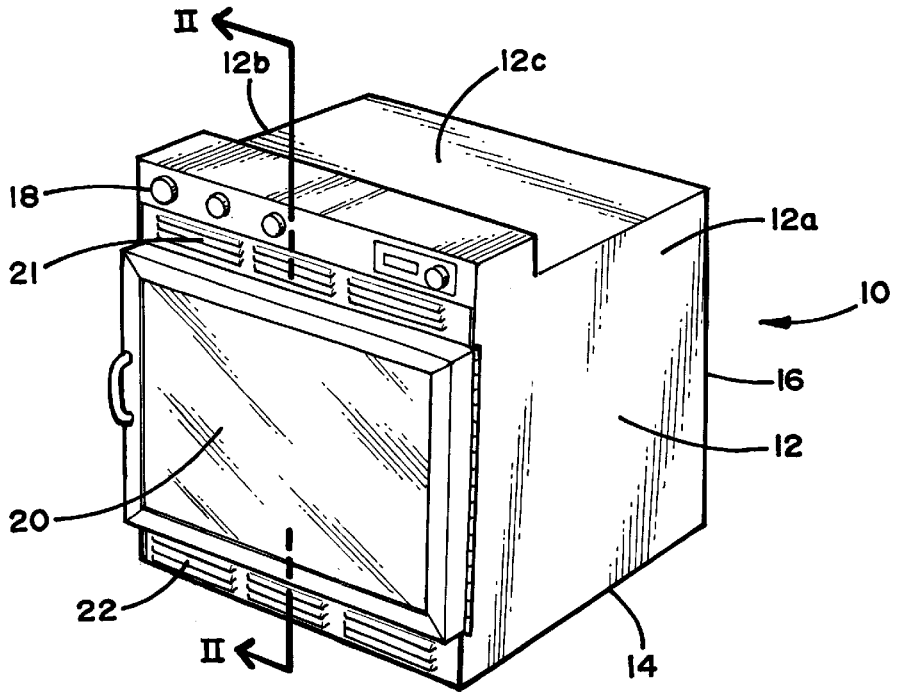
FIG. 1 is a perspective view of the oven embodying the present invention.

In FIG. 1 there is shown an oven 10 including an outer cabinet 12 having side walls 12*a* and 12*b* and a top wall 12*c*. A base plate 14 supports the cabinet 12 and a back wall 16 attaches to the rear of the cabinet 12 to complete a cabinet enclosure surrounding the oven. The front surface of the oven includes a plurality of controls 18 and a door 20 hingedly connected to the cabinet for allowing access to the interior of the oven. A plurality of upper vents 21 and lower vents 22 are provided to allow convection air flow within the cabinet for cooling the exterior surface of the oven.

Figure 2:
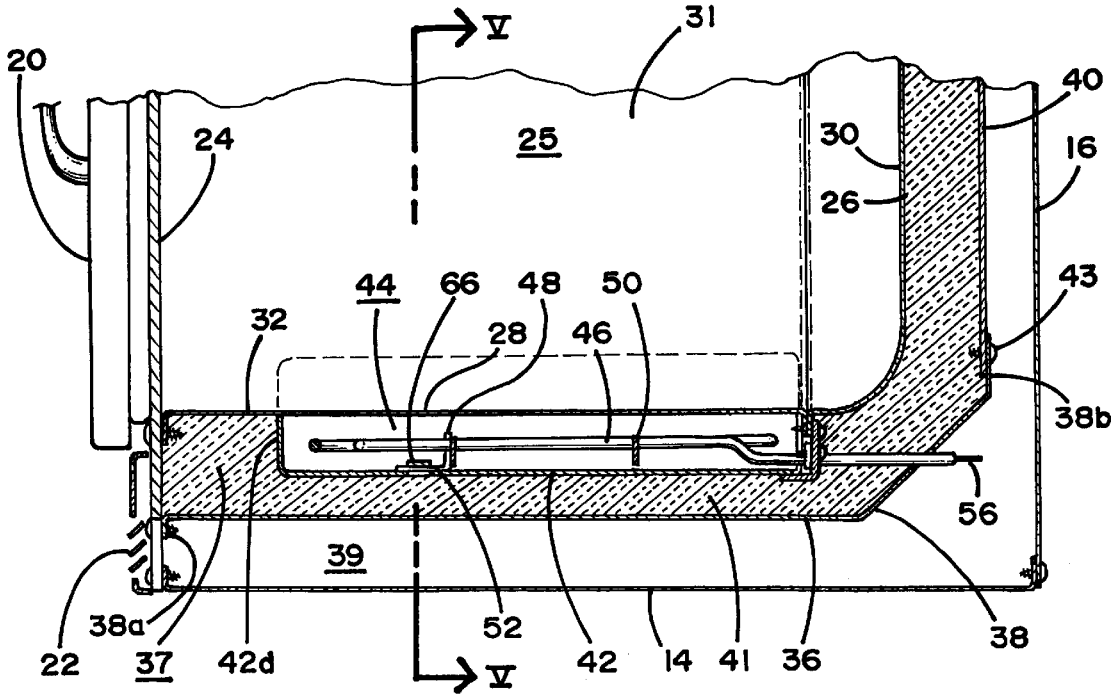
FIG. 2 is a sectional view taken along lines II—II of FIG. 1 showing the heating element compartment beneath the oven liner.
Figure 3:
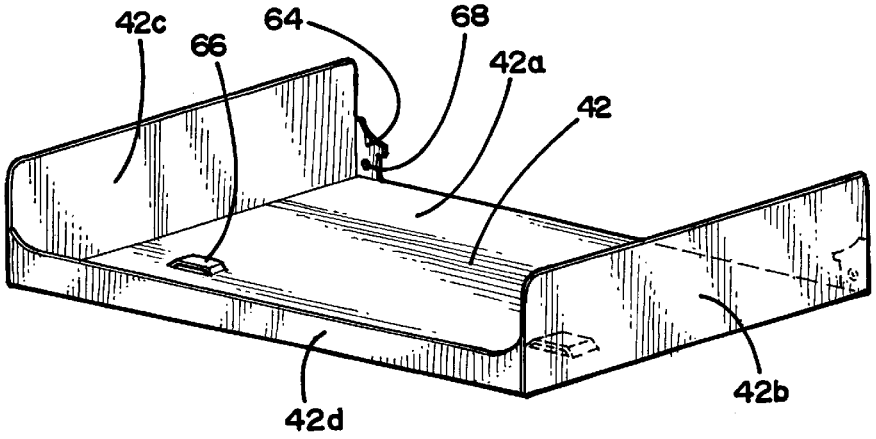
FIG. 3 is a perspective view of the heating element tray of the present invention.
Figure 4:
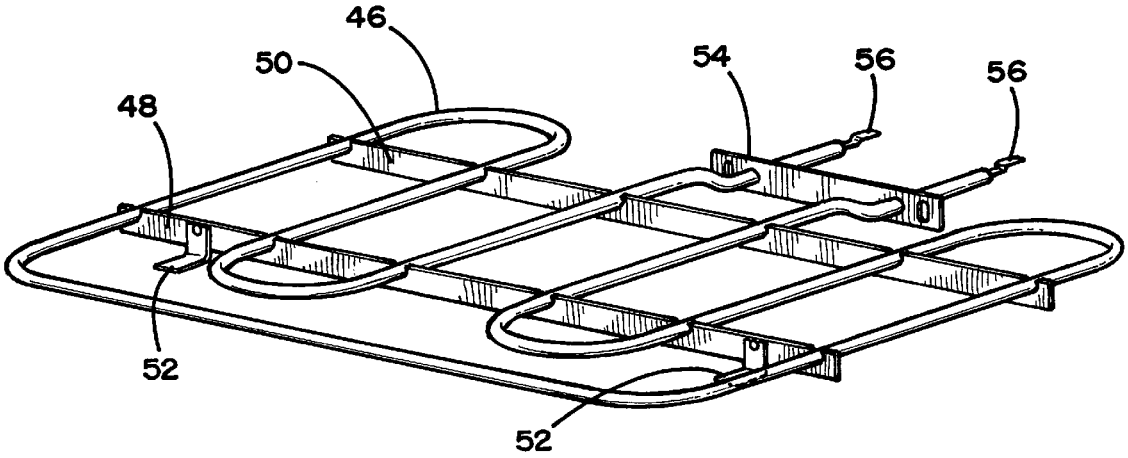
FIG. 4 is a perspective view of a heating element of the present invention.

Turning to FIG. 2, details of the oven construction can be shown. The oven includes a front frame 24 which extends along the front of the oven and serves as a relatively rigid element for supporting the main components of the oven. The front surface of the base plate 14 is flanged and connects to the front frame 24. The interior oven cavity 25 of the oven is defined by an oven liner 26 which is also supported along its front surface by the front frame 24. A plurality of racks (not shown) may be positioned within the oven cavity 25 for supporting food items to be cooked.

The oven liner 26 is formed from a plurality of panels including a wrapper panel 28 and a rear wall panel 30. The wrapper panel 28 forms side walls 31 and a bottom wall 32. Both the wrapper panel 28 and the rear wall panel 30 have flanged edges which are welded together. The connection between the wrapper panel 28 and the rear wall panel 30, therefore, forms ajoint flange 34 extending outwardly from the outer surface of the oven liner 26 near the rear portion of the oven liner 26.

An inner chassis 36 is provided about the oven liner 26 to form an insulation cavity 37 between the interior surface of the inner chassis 36 and the exterior surface of the oven liner wherein resilient insulation 41, such as fiberglass, is disposed within the insulation cavity 37. The inner chassis 36 includes a chassis bottom panel 38 and a rear chassis panel 40. The chassis bottom panel 38 has a front flanged edge 38*a* connected to the front frame 24 and has a rear edge 38*b* removably connected to the rear chassis panel 40 through use of threaded fasteners 43. In addition to the insulation cavity 37, the oven is insulated by an open air space 39 which is formed between the inner chassis 36 and the outer cabinet 12. Air flow is allowed through the open air space 39 for keeping the outer surfaces of the cabinet 12 acceptably cool. Further, wiring and control means are routed through the open air space 39.

Turning now to FIGS. 3–7 in combination with FIG. 2, further details of the present invention may be understood.

A heating element tray 42 is disposed between the bottom wall 32 of the oven liner and the bottom chassis panel 38. The heating element tray 42 includes a bottom wall 42*a*, side walls 42*b* and 42*c* and a relative short front wall 42*d*. The heating element tray 42 further includes rear comer tabs 64 having mounting holes 68. The heating element tray 42 is positioned adjacent the bottom surface of the bottom wall 32 of the oven liner and forms a heating element compartment 44 immediately below the oven compartment 26. The heating element compartment 44 includes a rear access opening 45. When positioned below the oven liner 26, the heating element side walls 42*b* and 42*c* frictionally engage the side walls of the oven liner 26 and the top edge of the front wall 42*d* abuts against the bottom surface of the bottom wall 32 of the oven liner.

A heating element 46 is supported within the heating element compartment 44. In this fashion, a hidden heating element oven configuration is provided wherein the heating element 46 is not visible from within the oven liner 26 but rather is disposed below the oven liner 26 such that the oven cavity may be effectively heated and easily cleaned. The heating element 46 includes a front support brace 48 and a rear support brace 50. The front support brace includes a pair of L-shaped members or feet 52. Moreover, the heating element 46 includes a grounding bracket 54 which supports the terminal ends 56 of the heating element 46.

Figure 6:
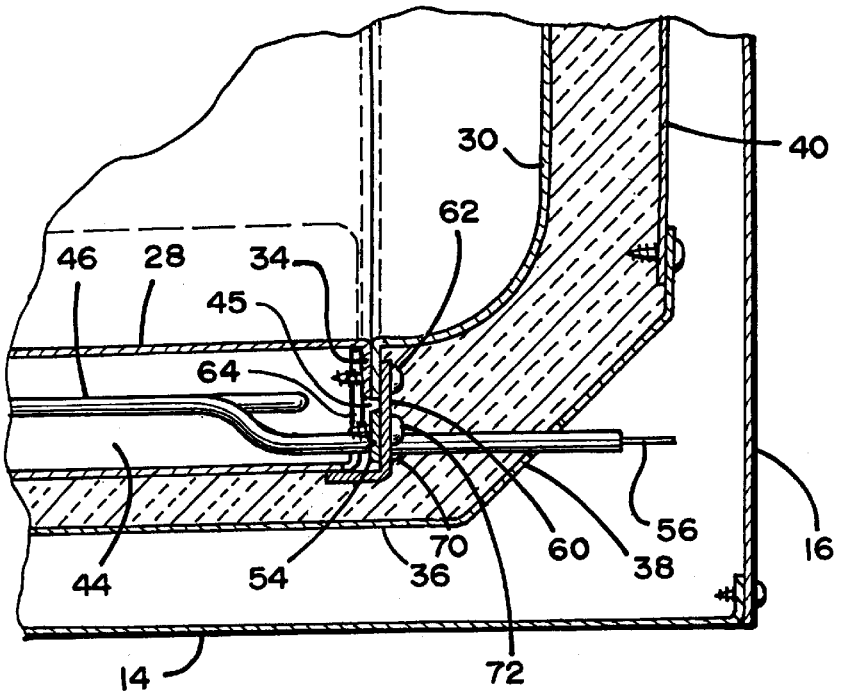
FIG. 6 is an enlarged area of FIG. 2, showing the connection between the heating element and the access panel.
Figure 5:
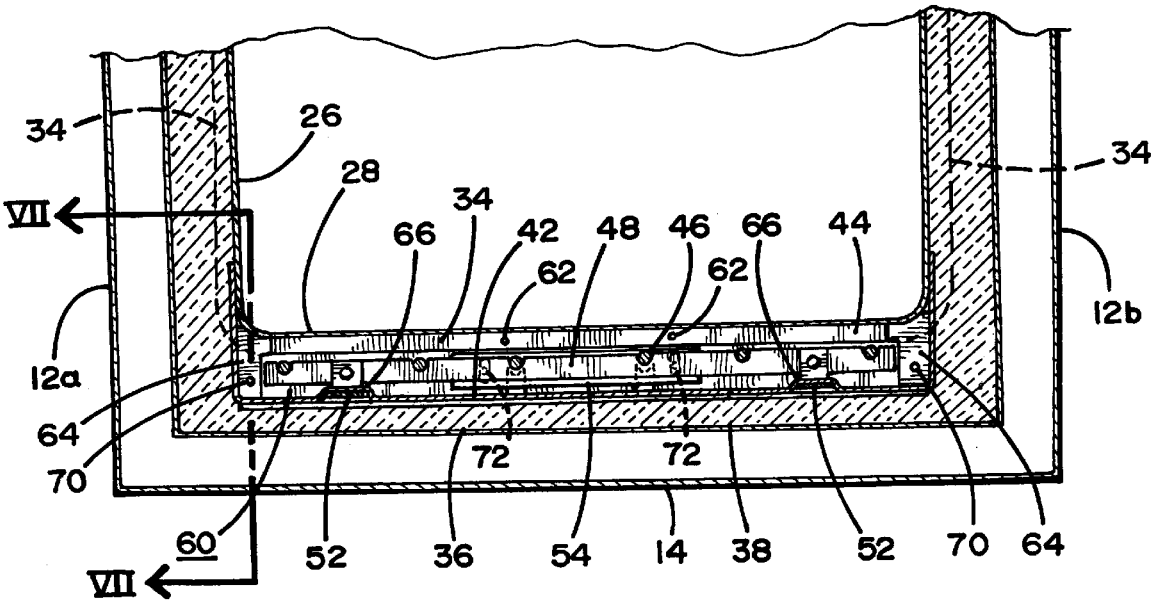
FIG. 5 is a sectional view taken along lines V—V of FIG. 2.

As best shown in FIG. 6, an access panel member 60 is provided for closing the rear access opening 45. The access panel 60 is attached to the oven flange 34 through use of threaded fasteners 62. The grounding bracket 54 of the heating element 46 is also secured to the access panel 60 by use of threaded fasteners 72. When secured to the access panel 60, the terminal ends 56 of the heating element 46 extend through the chassis bottom panel 38 into the open air space 39 wherein a wiring harness connection can be made.

Figure 7:
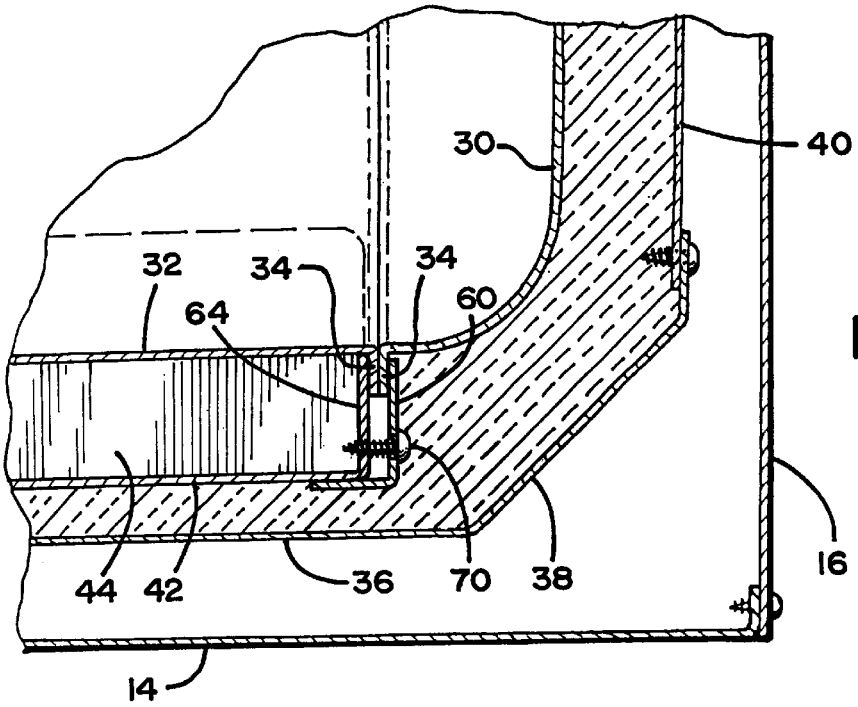
FIG. 7 is a sectional view taken along lines VII—VII of FIG. 5.

FIG. 7 illustrates how the heating element tray 42 is secured to the access panel member 60. Along the side edge portions of the access panel, threaded fasteners 70 extend through the access panel 60 and engage the mounting holes 68 provided on the rear corner tabs 64 of the tray 42. The two fasteners 70 secure the tray 42 to the access panel 60, and the tray, as described above, is secured to the oven flange 34 by fasteners 62.

It can be understood by one skilled in the art, therefore, that the tray 42 may be initially secured to the bottom of the oven liner 26 by press fitting the side walls 42*b* and 42*c* of the tray onto the oven liner 26. The assembly of the chassis bottom panel 38 further secures the tray 42 in position by compressing fiberglass insulation 41 between the tray 42 and the chassis bottom panel 38. The tray is then securely fastened to the oven flange 34 along its rear edge by way of the access panel 60, as described above.

Replacement of a failed heating element may be accomplished in a relatively simple manner. The oven 10 is initially removed from the cabinet opening in which it is supported. The back wall 16 is then removed, exposing the rear chassis panel 40. The chassis bottom panel 38 is disconnected from the rear chassis panel 40 by removal of the threaded fasteners 43. This allows the back edge of the chassis bottom panel 38 to be flexed downwardly to provide access to the access panel 60. The access panel 60 can then be disconnected from the oven flange 34, tray 42 and grounding bracket 54 and removed allowing the heating element 46 to be withdrawn from the heating element enclosure 44 through the rear access opening.

A new heating element 46 may be inserted into the heating enclosure 44. This installation is facilitated by the engagement between the feet 52 provided on the heating element cross-brace 48 and a pair of engagement slots or stirrups 66 provided on the tray 42. The heating element 46 is guided into place within the tray 42. Once a new heating element is installed, the oven can be reassembled and reinstalled into the cabinet opening.

Figure 8:
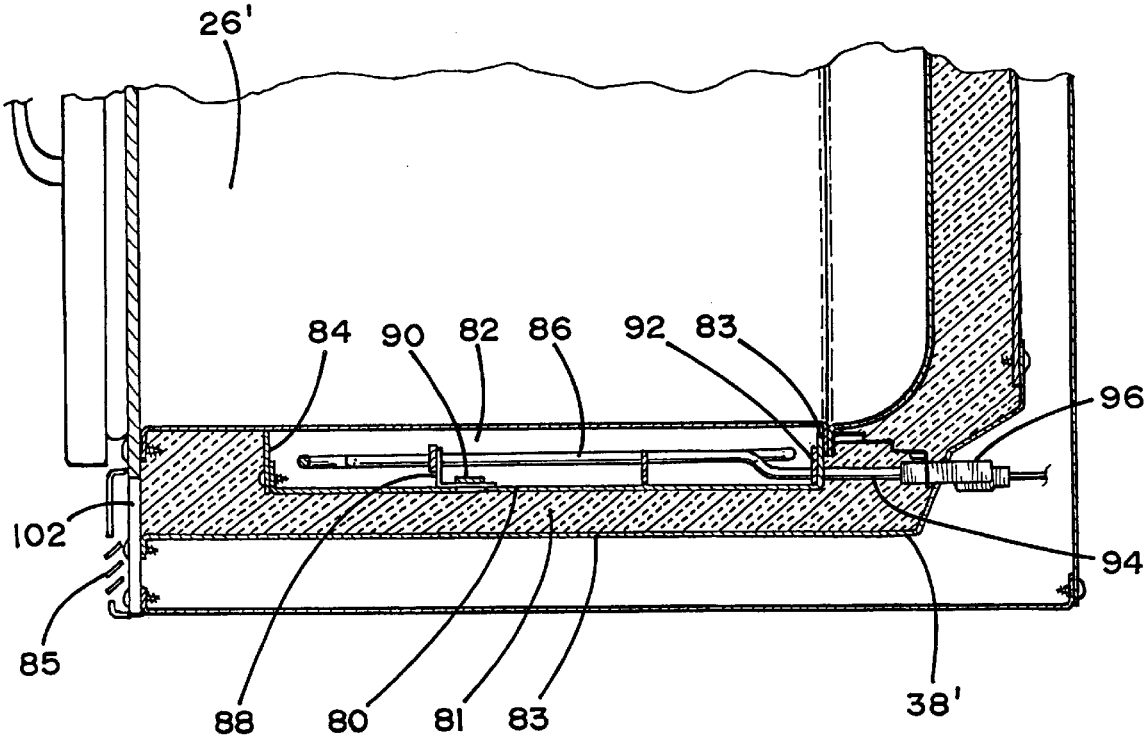
FIG. 8 is a sectional view of an alternate embodiment of the present invention, showing the heating element compartment beneath the oven liner.

An alternate embodiment to the present invention is illustrated in FIG. 8. In this embodiment, the heating element is serviced from the front of the oven. Similar to the first embodiment, a heating element tray 80 is provided below the oven liner 26' for forming a heating element enclosure 82. The tray 80 is positioned within a lower insulation cavity 81 and is held adjacent to the bottom surface of the oven liner by press fitting the tray side walls about the oven liner 26' and compressing insulation between the chassis bottom panel 38' and the tray 80. A removable front cover 85 is disposed across a front access opening 102 which provides access into the lower insulation cavity 81. The tray 80 includes a rear wall 83 and a front panel 84 is removably connected to the front edge of the tray 80.

A heating element 86 is slidably received in the heating element enclosure 82. The heating element 86 includes feet 88 which may be received into stirrups 90 formed into the tray 80. The heating element 86 further includes a stop bracket 92 which supports the terminal ends 94 of the heating element 86. When installed into the heating element enclosure 82, the stop bracket 92 engages the rear wall 83 of the tray 80 and the terminal ends 94, extending through the rear wall 83, connect to an electrical connection receptacle 96.

The alternative embodiment provides a system wherein a failed heating element may be serviced in a relatively simple fashion. The first step in replacing a failed heating element is to remove the front cover 98. The allows access to the front edge of the tray 80 which may pulled downward such that the front of the tray 80 pivots downward. The electrical connection receptacle 96 is supported such that it may pivot with tray 80. The front panel 84 is then removed from the tray 80 such that the heating element 86 can be accessed and removed. A new heating element can then be inserted into the tray 80 such that the feet 88 are received into the stirrups 90 and the stop bracket 92 engages the rear wall 83. Insertion in this manner causes electrical connection to be made between the electrical connection receptacle 96 and the terminal ends 94 of the heating element 86.

It can be seen, therefore, that the present invention provides a unique system for supporting a heating element beneath an oven liner. Although the present invention has been described with reference to specific embodiments, those of skill in the Art will recognize that changes may be made thereto without departing from the scope and spirit of the invention as set forth in the appended claims.

We claim:

1. An oven, comprising:

an oven liner having opposite side walls and a bottom wall;

a tray disposed beneath the bottom wall of the oven liner for forming a heating element compartment, the heating element compartment having an access opening;

a heating element removably supported by the tray beneath the bottom wall of the oven liner wherein the heating element is inserted into the heating element compartment through the access opening; and an access panel for closing the access opening of the heating element compartment, wherein the oven includes a joint flange outwardly extending from the oven liner and wherein the access panel is removably attached to the joint flange, and the heating element includes a grounding bracket which is removably attached to the access panel.

2. An oven, comprising:

an oven liner having opposite side walls and a bottom wall;

a tray disposed beneath the bottom wall of the oven liner for forming a heating element compartment, the heating element compartment having an access opening;

a heating element removably supported by the tray beneath the bottom wall of the oven liner wherein the heating element is inserted into the heating element compartment through the access opening; and an access panel for closing the access opening of the heating element compartment;

an inner chassis disposed about the oven liner forming an insulation cavity in the space between the inner chassis and the oven liner, the inner chassis including a rear chassis panel and a chassis bottom panel having a rear edge removably attached to the rear chassis panel; and a cabinet enclosure surrounding the inner chassis forming an open air space in the space between the inner chassis and the cabinet enclosure, the cabinet having a removable back wall, wherein the tray is disposed within the insulation cavity and access to the tray is accomplished by removing the back wall and disconnecting the chassis bottom panel from the rear chassis panel such that the chassis bottom panel may be flexed to expose the access panel.

3. An oven, comprising:

an oven liner having opposite side walls and a bottom wall;

a tray disposed beneath the bottom wall of the oven liner for forming a heating element compartment, the heating element compartment having an access opening, the tray having a bottom wall and opposite side walls and at least one stirrup on the bottom wall of the tray, the at least one stirrup forming an opening on the bottom wall;

a heating element removably supported by the tray beneath the bottom wall of the oven liner wherein the heating element is inserted into the heating element compartment through the access opening; and an access panel for closing the access opening of the heating element compartment; and a bracket supporting the heating element, the bracket including at least one mounting foot corresponding to the at least one stirrup such that when the heating element is inserted into the heating element compartment the at least one mounting foot is received into the opening formed by the at least one stirrup.

4. An oven, comprising:

an oven liner having opposite side walls and a bottom wall;

a tray disposed beneath the bottom wall of the oven liner for forming a heating element compartment, the heating element compartment having a rear access opening, the tray having a bottom wall and opposite side wall wherein the side walls of the tray extending upwardly adjacent the oven liner side walls for frictionally engaging the side walls of the oven such that the tray is secured to the oven liner;

a heating element removably supported by the tray beneath the bottom wall of the oven liner wherein the heating element is inserted into the heating element compartment through the rear access opening; and an access panel for closing the rear access opening of the heating element compartment.

5. An oven, comprising:

a oven liner having a rear wall, opposite side walls, a top wall and a bottom wall;

a tray having a bottom wall, opposite side walls and a front wall wherein the tray is disposed beneath the oven liner for forming a heating element compartment beneath the bottom wall of the oven liner, the heating element compartment having a rear access opening;

a heating element having a support bracket for supporting the heating element within the heating element enclosure, the heating element being inserted into the heating element compartment through the rear access opening; and an access panel for closing the rear access opening of the heating element enclosure wherein the access panel is secured to the oven liner and the tray is fastened to the access panel.

6. An oven comprising;

an oven liner having a rear wall, opposite side walls, a top wall and a bottom wall;

a tray having a bottom wall, opposite side walls and a front wall wherein the tray is disposed beneath the oven liner for forming a heating element compartment beneath the bottom wall of the oven liner, the heating element compartment having a rear access opening;

a heating element having a support bracket for supporting the heating element within the heating element enclosure, the heating element being inserted into the heating element compartment through the rear access opening;

an access panel for closing the rear access opening of the heating element enclosure wherein the access panel is secured to the oven liner and the tray is fastened to the access panel;

the bottom wall of the tray includes a plurality of stirrups formed thereon; and the bracket supporting the heating element includes mounting tabs corresponding to the stirrups such that when the heating element is inserted into the heating element enclosure the mounting tabs are received into the stirrups.

* * * * *